US010790129B2

(12) United States Patent
Nagata et al.

(10) Patent No.: US 10,790,129 B2
(45) Date of Patent: Sep. 29, 2020

(54) TRANSMISSIVE PHOTOCATHODE AND ELECTRON TUBE

(71) Applicant: HAMAMATSU PHOTONICS K.K., Hamamatsu-shi, Shizuoka (JP)

(72) Inventors: Takaaki Nagata, Hamamatsu (JP); Yoshihiro Ishigami, Hamamatsu (JP); Yasumasa Hamana, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 16/634,693

(22) PCT Filed: May 14, 2018

(86) PCT No.: PCT/JP2018/018520
§ 371 (c)(1),
(2) Date: Jan. 28, 2020

(87) PCT Pub. No.: WO2019/026381
PCT Pub. Date: Feb. 7, 2019

(65) Prior Publication Data

US 2020/0234935 A1 Jul. 23, 2020

(30) Foreign Application Priority Data

Aug. 4, 2017 (JP) ..... 2017-151870

(51) Int. Cl.
*H01J 40/06* (2006.01)
*H01J 40/16* (2006.01)

(52) U.S. Cl.
CPC ..... *H01J 40/06* (2013.01); *H01J 40/16* (2013.01)

(58) Field of Classification Search
None
See application file for complete search history.

(56) References Cited

U.S. PATENT DOCUMENTS

2001/0001226 A1 5/2001 Nihashi
2013/0293100 A1 11/2013 Moody
(Continued)

FOREIGN PATENT DOCUMENTS

JP H04-345742 A 12/1992
JP 2012-527620 A 11/2012
(Continued)

OTHER PUBLICATIONS

Yoon, Duhee et al., "Negative Thermal Expansion Coefficient of Graphene Measured by Raman Spectroscopy," Nano Lett, 2011 (11), pp. 3227-3231.
(Continued)

*Primary Examiner* — Vip Patel
(74) *Attorney, Agent, or Firm* — Faegre Drinker Biddle & Reath LLP

(57) ABSTRACT

A transmissive photocathode includes a light transmitting substrate that has a first surface on which light is incident and a second surface which emits light incident from a side of the first surface, a photoelectric conversion layer that is provided on the second surface side of the light transmitting substrate and converts the light emitted from the second surface into photoelectrons, a light transmitting conductive layer that is provided between the light transmitting substrate and the photoelectric conversion layer and is composed of a single-layered graphene, and a thermal stress alleviation layer that is provided between the photoelectric conversion layer and the light transmitting conductive layer and has light transmissivity. A thermal expansion coefficient of the thermal stress alleviation layer is smaller than a thermal expansion coefficient of the photoelectric conversion layer and larger than a thermal expansion coefficient of the graphene.

7 Claims, 15 Drawing Sheets

(56) References Cited

U.S. PATENT DOCUMENTS

| | | | |
|---|---|---|---|
| 2014/0014169 | A1 | 1/2014 | Rand et al. |
| 2015/0014544 | A1 | 1/2015 | Stephenson et al. |

FOREIGN PATENT DOCUMENTS

| | | | |
|---|---|---|---|
| JP | 2013-80565 | A | 5/2013 |
| JP | 2013-522821 | A | 6/2013 |
| JP | 2015-31666 | A | 2/2015 |
| JP | 2015-88403 | A | 5/2015 |
| JP | 5899187 | B2 | 4/2016 |
| JP | 2016-126839 | A | 7/2016 |
| WO | WO-2010/135303 | A2 | 11/2010 |
| WO | WO-2011/112086 | A1 | 9/2011 |
| WO | WO-2016/021266 | A1 | 2/2016 |

OTHER PUBLICATIONS

International Preliminary Report on Patentability dated Feb. 13, 2020 for PCT/JP2018/018520.

(a)

EXAMPLE 1

(b)

COMPARATIVE EXAMPLE (a)

EXAMPLE 1

(b)

COMPARATIVE EXAMPLE

*Fig.10*

| | LIGHT TRANSMITTING SUBSTRATE | THERMAL STRESS ALLEVIATION LAYER | THERMAL EXPANSION COEFFICIENT ($10^{-6}$/K) | ENERGY GAP (eV) | ABSORPTION END WAVELENGTH (nm) |
|---|---|---|---|---|---|
| EXAMPLE 1 | UV RAY TRANSMITTING GLASS | $Al_2O_3$ | 7 | 8.2 | 151 |
| EXAMPLE 2 | | $HfO_2$ | 3.8 | 6 | 207 |
| EXAMPLE 3 | | $Cr_2O_3$ | 6.2 | 3.7 | 335 |
| EXAMPLE 4 | | $Ga_2O_3$ | 8.2~8.5 | 4.8 | 258 |
| EXAMPLE 5 | | $MgF_2$ | 8.48 | 11.8 | 105 |
| EXAMPLE 6 | | $Y_2O_3$ | 10.1 | 3 | 413 |

(a)

EXAMPLE 1

(b)

EXAMPLE 2

(c)

EXAMPLE 3

(a)

EXAMPLE 4

(b)

EXAMPLE 5

(c)

EXAMPLE 6

(a)

ONE LAYER (b)

TWO LAYERS (c)

THREE LAYERS (d)

THREE LAYERS (ENLARGED)

TRANSMISSIVE PHOTOCATHODE AND ELECTRON TUBE

TECHNICAL FIELD

The present disclosure relates to a transmissive photocathode and an electron tube.

BACKGROUND ART

There is a transmissive photocathode including a light transmitting substrate that has a first surface on which light is incident and a second surface which emits the light incident from the first surface side, a photoelectric conversion layer that is provided on a light emission side of the light transmitting substrate and converts the light emitted from the second surface into photoelectrons, and a light transmitting conductive layer that is provided between the light transmitting substrate and the photoelectric conversion layer and is constituted of a graphene (for example, refer to Patent Literature 1).

CITATION LIST

Patent Literature

Patent Literature 1: Japanese Patent No. 5899187

SUMMARY OF INVENTION

Technical Problem

In transmissive photocathodes as described above, a light transmitting conductive layer constituted of a graphene having both excellent light transmissivity and high conductivity is provided between a light transmitting substrate and a photoelectric conversion layer, and therefore both retention of sufficient sensitivity and improvement of linearity can be achieved. In order to further enhance the sensitivity in such a transmissive photocathode, it is conceivable that the light transmitting conductive layer be constituted of a single-layered graphene. However, depending on the types of the light transmitting substrate and the photoelectric conversion layer, there are cases where defects such as creases or breakage occur in the light transmitting conductive layer at the time of manufacturing, and sensitivity is degraded at positions where the defects have occurred.

Therefore, an object of an aspect of the present disclosure is to provide a transmissive photocathode and an electron tube, in which occurrence of defects in a light transmitting conductive layer can be curbed even when a single-layered graphene is used as the light transmitting conductive layer.

Solution to Problem

According to an aspect of the present disclosure, there is provided a transmissive photocathode including a light transmitting substrate that has a first surface on which light is incident and a second surface which emits the light incident from the first surface side, a photoelectric conversion layer that is provided on the second surface side of the light transmitting substrate and converts the light emitted from the second surface into photoelectrons, a light transmitting conductive layer that is provided between the light transmitting substrate and the photoelectric conversion layer and is composed of a single-layered graphene, and a thermal stress alleviation layer that is provided between the photoelectric conversion layer and the light transmitting conductive layer and has light transmissivity. A thermal expansion coefficient of the thermal stress alleviation layer is smaller than a thermal expansion coefficient of the photoelectric conversion layer and larger than a thermal expansion coefficient of the graphene.

In this transmissive photocathode, the light transmitting conductive layer is constituted of a single-layered graphene. Accordingly, compared to a case where the light transmitting conductive layer is constituted of a plurality of graphene layers, light transmittance of the light transmitting conductive layer can be enhanced, and sensitivity can be enhanced. In addition, the inventors have found that defects in the light transmitting conductive layer as described above occur due to a difference between the thermal expansion coefficients of the graphene and the photoelectric conversion layer when the photoelectric conversion layer is formed on the light transmitting conductive layer. Based on this knowledge, in this transmissive photocathode, the thermal stress alleviation layer having a thermal expansion coefficient smaller than the thermal expansion coefficient of the photoelectric conversion layer and larger than the thermal expansion coefficient of the graphene is provided between the photoelectric conversion layer and the light transmitting conductive layer.

Accordingly, it is possible to alleviate thermal stress acting on the light transmitting conductive layer when the photoelectric conversion layer is formed. As a result, occurrence of defects in the light transmitting conductive layer can be curbed even when a single-layered graphene is used as the light transmitting conductive layer.

In the transmissive photocathode according to the aspect of the present disclosure, the thermal expansion coefficient of the thermal stress alleviation layer may be within a range of $0.0\times10^{-6}$/K to $10.0\times10^{-6}$/K. In this case, occurrence of defects in the light transmitting conductive layer can be curbed reliably.

In the transmissive photocathode according to the aspect of the present disclosure, the thermal stress alleviation layer may be composed of oxide or fluoride. In this case, occurrence of defects in the light transmitting conductive layer can be curbed more reliably.

In the transmissive photocathode according to the aspect of the present disclosure, the thermal stress alleviation layer may be composed of aluminum oxide, hafnium oxide, chromium oxide, gallium oxide, silicon oxide, or magnesium fluoride. In this case, occurrence of defects in the light transmitting conductive layer can be curbed still more reliably.

In the transmissive photocathode according to the aspect of the present disclosure, the light transmitting substrate may be formed of an UV ray transmitting material. In this case, in the transmissive photocathode which is highly sensitive in a wavelength range including UV rays, occurrence of defects in the light transmitting conductive layer can be curbed.

In the transmissive photocathode according to the aspect of the present disclosure, the photoelectric conversion layer may be constituted by including antimony or tellurium and an alkali metal. In this case, in the transmissive photocathode which is highly sensitive in a wavelength range including UV rays, occurrence of defects in the light transmitting conductive layer can be curbed.

According to another aspect of the present disclosure, there is provided an electron tube including the transmissive photocathode described above. According to this electron tube, for the reasons described above, occurrence of defects in a light transmitting conductive layer can be curbed even when a single-layered graphene is used as the light transmitting conductive layer.

Advantageous Effects of Invention

According to the aspects of the present disclosure, occurrence of defects in a light transmitting conductive layer can be curbed even when a single-layered graphene is used as the light transmitting conductive layer.

BRIEF DESCRIPTION OF DRAWINGS

FIG. 10 is a table showing constitutions of transmissive photocathodes according to Examples 1 to 6.

DESCRIPTION OF EMBODIMENT

Figure 1:
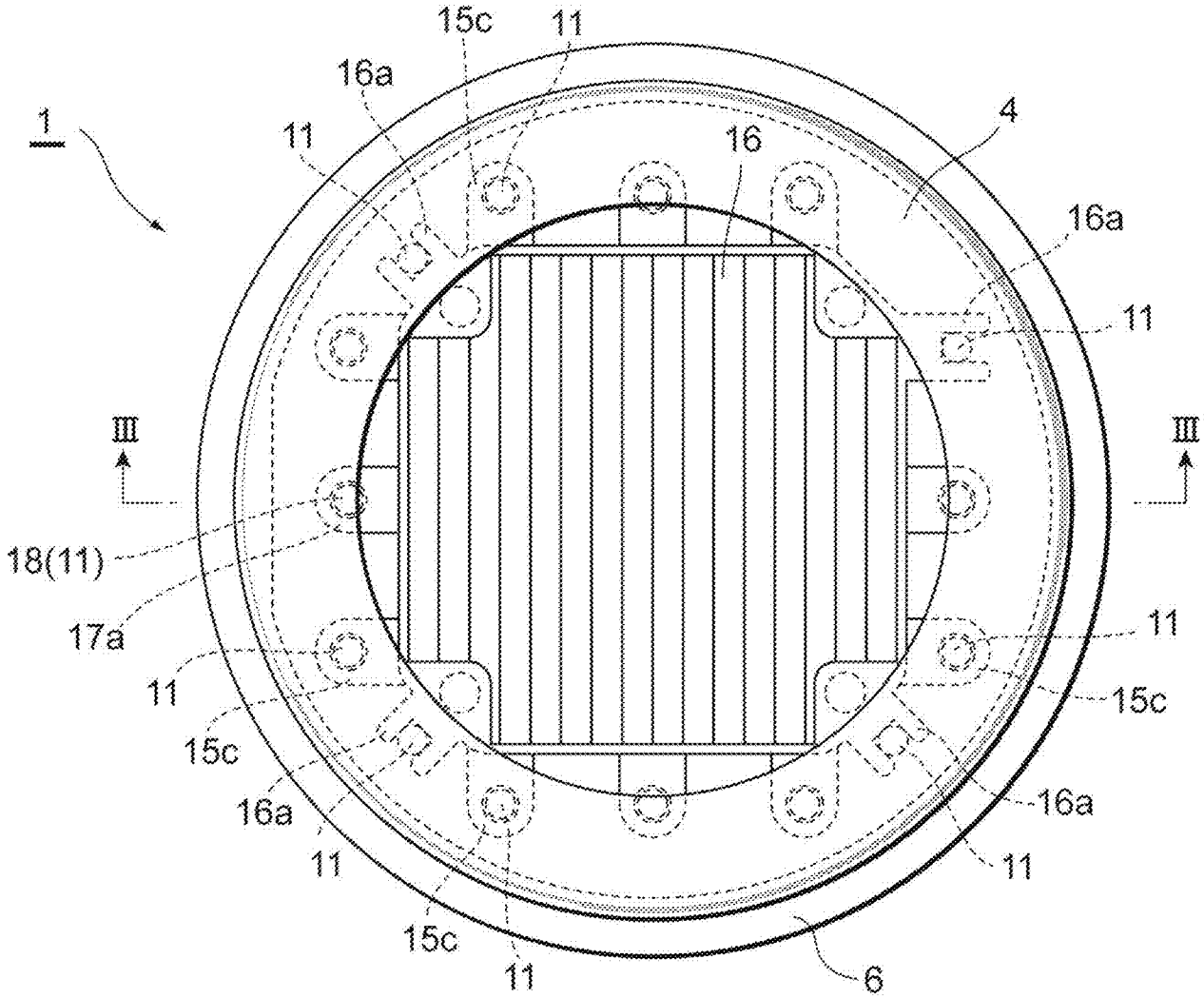
FIG. 1 is a plan view illustrating a photomultiplier tube using a transmissive photocathode according to an embodiment.

Hereinafter, with reference to the drawings, an embodiment of a transmissive photocathode according to an aspect of the present disclosure will be described. In the following description, terms such as "up" and "down" are for convenience based on the state illustrated in the drawings. In each of the diagrams, the same reference signs are applied to parts which are the same or corresponding, and duplicate description will be omitted. In the drawings, there are parts which are exaggerated partially in order to make description of characteristic parts easy to understand, and dimensions of the parts differ from actual dimensions. In the present embodiment, as an example, a transmissive photocathode 2 used as a transmissive photocathode in a photomultiplier tube 1 will be described.

Figure 2:
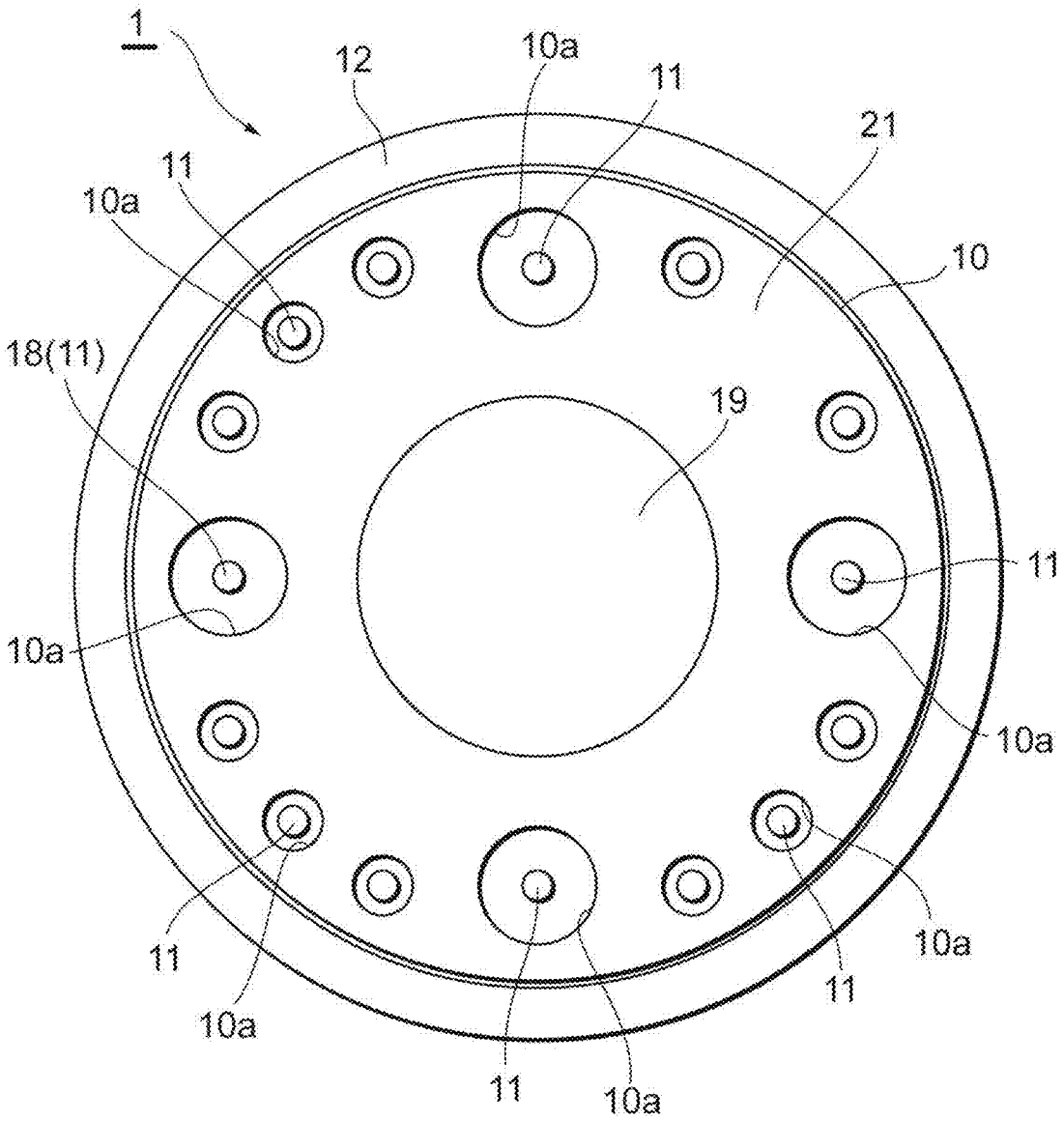
FIG. 2 is a bottom view of the photomultiplier tube illustrated in FIG. 1.
Figure 3:
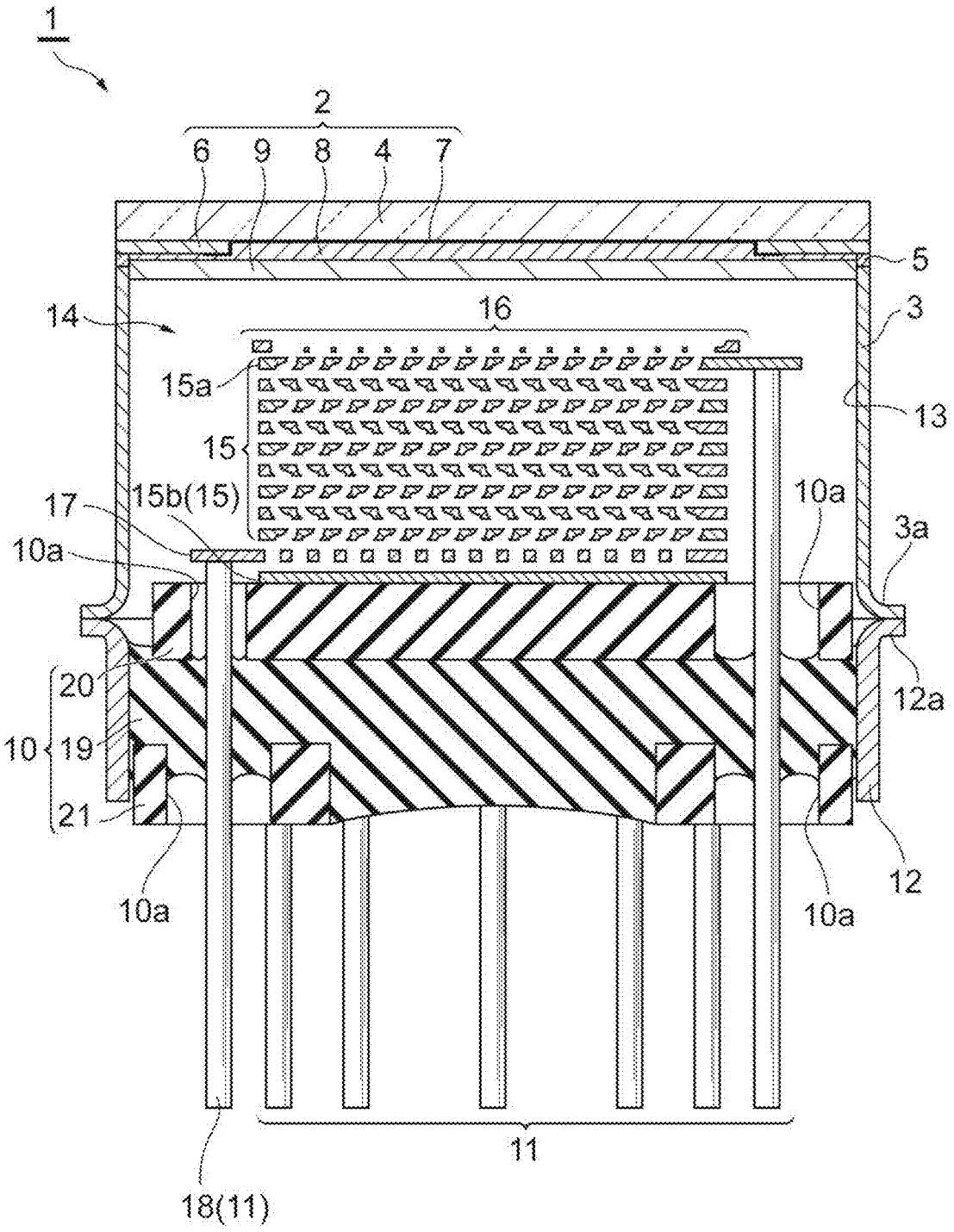
FIG. 3 is a cross-sectional view taken along line III-III in FIG. 1.

As illustrated in FIGS. 1 to 3, the photomultiplier tube 1 (electron tube) has a metal side tube 3 having a substantially cylindrical shape. As illustrated in FIG. 3, the transmissive photocathode 2 is air-tightly fixed to an upper end portion of the cylindrical side tube 3 with a seal member 5 which is interposed therebetween and is formed of a conductive material. The transmissive photocathode 2 includes a light transmitting substrate 4 having favorable light transmissivity with respect to incident light (detected light). A photoelectric conversion layer 9 is provided on a light emission side (inner surface 4*b* side) of the light transmitting substrate 4 with a contact portion 6 formed of a conductive material, a light transmitting conductive layer 7 having light transmissivity and conductivity, and a thermal stress alleviation layer 8 having light transmissivity and conductivity interposed therebetween. The photoelectric conversion layer 9 converts incident light which is transmitted through the light transmitting substrate 4, the light transmitting conductive layer 7, and the thermal stress alleviation layer 8 into photoelectrons. The light transmitting conductive layer 7 comes into contact with the contact portion 6 and is electrically connected to the side tube 3 with the seal member 5 interposed therebetween. The transmissive photocathode 2 according to the present embodiment is constituted of the light transmitting substrate 4, the contact portion 6, the light transmitting conductive layer 7, the thermal stress alleviation layer 8 and the photoelectric conversion layer 9. The detailed constitution of the transmissive photocathode 2 will be described after the overall constitution of the photomultiplier tube 1 is described.

As illustrated in FIGS. 2 and 3, a disk-shaped stem 10 is disposed at an opening end of the side tube 3 on the lower side. A plurality of conductive stem pins 11 disposed at positions substantially on the circumference away from each other in the circumferential direction are air-tightly inserted and attached to the stem 10. The stem pins 11 are inserted through openings 10*a* formed on an upper surface side and a lower surface side of the stem 10 at positions corresponding to each other. A metal ring-shaped side tube 12 is air-tightly fixed such that the stem 10 is laterally surrounded. As illustrated in FIG. 3, a flange portion 3*a* which is formed in a lower end portion of the side tube 3 on the upper side and a flange portion 12*a* which has the same diameter and is formed in an upper end portion of the ring-shaped side tube 12 on the lower side are welded to each other, and the side tube 3 and the ring-shaped side tube 12 are air-tightly fixed to each other. Accordingly, a sealed container 13 which is constituted of the side tube 3, the seal member 5, the contact portion 6, the light transmitting substrate 4, and the stem 10 and of which the inside is maintained in a vacuum state is formed.

An electron multiplier 14 for multiplying photoelectrons released from the photoelectric conversion layer 9 is accommodated inside the sealed container 13 formed in this manner. This electron multiplier 14 is formed to have a block shape due to thin plate-shaped dynode plates 15 which have a number of electron multiplier holes and are stacked in a plurality of layers, and is installed on the upper surface of the stem 10. As illustrated in FIG. 1, a dynode plate connection piece 15*c* protruding outward is formed in an edge portion of each of the dynode plates 15. A distal end part of a predetermined stem pin 11 attached to the stem 10 by insertion is welded and fixed to the lower surface side of each of the dynode plate connection pieces 15*c*. Accordingly, electrical connection between each of the dynode plates 15 and each of the stem pins 11 is realized.

Moreover, as illustrated in FIG. 3, inside the sealed container 13, a flat plate-shaped focusing electrode 16 for focusing and introducing photoelectrons released from the photoelectric conversion layer 9 to the electron multiplier 14 is installed between the electron multiplier 14 and the photoelectric conversion layer 9. A flat plate-shaped anode (positive pole) 17 for taking out secondary electrons which are multiplied by the electron multiplier 14 and are released from a dynode plate 15*b* in the last stage as an output signal is stacked in a stage one higher than the dynode plate 15*b* in the last stage. As illustrated in FIG. 1, protruding pieces 16*a* protruding outward are formed in four corners of the focusing electrode 16. When a predetermined stem pin 11 is welded and fixed to each of the protruding pieces 16*a*, the stem pins 11 and the focusing electrode 16 are electrically connected to each other. An anode connection piece 17*a* protruding outward is formed in a predetermined edge portion of the anode 17 as well. When an anode pin 18 which is one of the stem pins 11 is welded and fixed to this anode connection piece 17*a*, the anode pin 18 and the anode 17 are electrically connected to each other. A voltage is applied due to the stem pins 11 connected to a power supply circuit (not illustrated) such that the photoelectric conversion layer 9 and the focusing electrode 16 have the same potential and each of the dynode plates 15 has a higher potential in the stacked order from the upper stage toward the lower stage. In addition, a voltage is applied such that the anode 17 has a higher potential than the dynode plate 15*b* in the last stage.

As illustrated in FIG. 3, the stem 10 has a three-layer structure including a base material 19, an upper pressing member 20 joined to the upper side (inner side) of the base material 19, and a lower pressing member 21 joined to the lower side (outer side) of the base material 19. The ring-shaped side tube 12 described above is fixed to a side surface of the stem 10. In the present embodiment, when the side surface of the base material 19 constituting the stem 10 and an inner wall surface of the ring-shaped side tube 12 are joined to each other, the stem 10 is fixed to the ring-shaped side tube 12.

Figure 4:
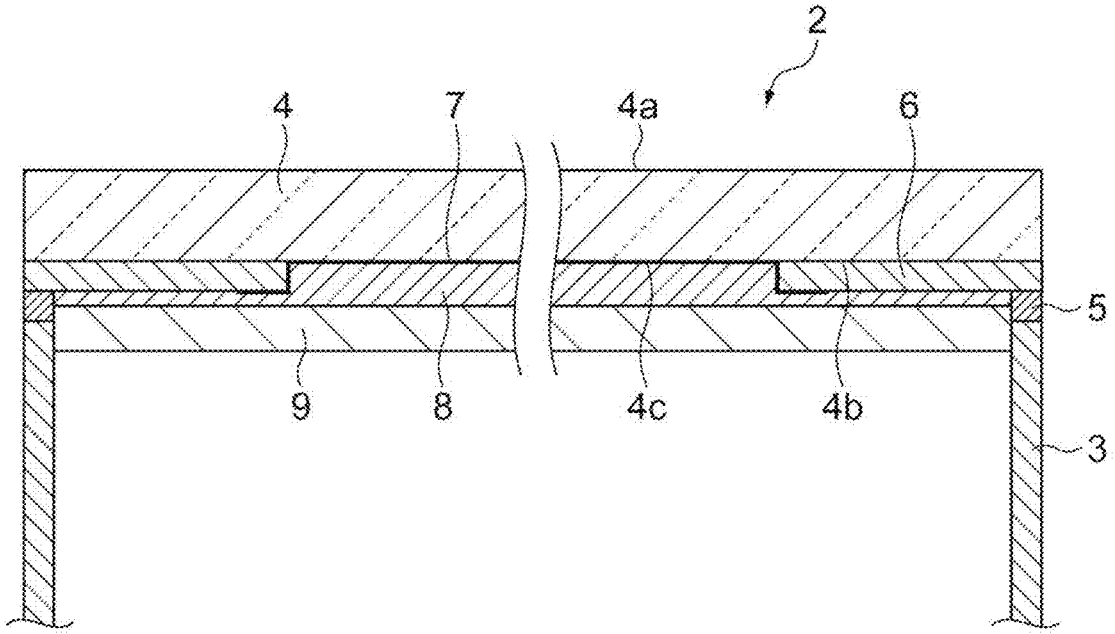
FIG. 4 is a schematic lateral cross-sectional view of the transmissive photocathode illustrated in FIG. 1.

Subsequently, with reference to FIG. 4, the detailed constitution of the transmissive photocathode 2 will be described. FIG. 4 is a schematic lateral cross-sectional view of the transmissive photocathode 2. As described above, the transmissive photocathode 2 includes the light transmitting substrate 4, the contact portion 6, the light transmitting conductive layer 7, the thermal stress alleviation layer 8, and the photoelectric conversion layer 9 and is fixed to the upper end portion of the side tube 3 with the seal member 5 interposed therebetween. The light transmitting substrate 4 is formed of an UV ray transmitting material, for example, and has favorable light transmissivity with respect to UV rays. As a material constituting the light transmitting substrate 4, synthetic quartz, Kovar glass, UV ray transmitting glass (UV glass) including silicon dioxide ($SiO_2$) and boron oxide ($B_2O_3$) as main components, or the like can be used. The light transmitting substrate 4 is formed to have a disk shape corresponding to the shape of the upper end portion of the side tube 3. The light transmitting substrate 4 has an outer surface (first surface) 4*a* which faces an external space and on which light is incident, and an inner surface (second surface) 4*b* which faces a vacuum space and is on a side opposite to the outer surface 4*a*. Light incident from the outer surface 4*a* side is transmitted through the inside of the light transmitting substrate 4 and is emitted from the inner surface 4*b*.

The seal member 5 is formed of a metal such as aluminum, for example, to have a circular ring shape corresponding to the shape of the upper end portion of the side tube 3. The contact portion 6 is a metal film formed of a metal such as chromium, for example, to have a circular ring shape. The contact portion 6 has a film thickness of approximately 100 mm, for example, and is electrically connected to the seal member 5. The contact portion 6 is provided on the inner surface 4*b* of the light transmitting substrate 4 by vapor deposition, for example. An outer edge of the contact portion 6 is laid along the outer edge of the light transmitting substrate 4, and an inner edge of the contact portion 6 surrounds a photoelectric conversion region 4*c* disposed in a central portion of the light transmitting substrate 4. In other words, the photoelectric conversion region 4*c* is defined by the inner edge of the contact portion 6 in the central portion of the light transmitting substrate 4.

The light transmitting conductive layer 7 is provided in a direct contact state on the photoelectric conversion region 4*c* that is a circular region in which the contact portion 6 is not provided on the inner surface 4*b* of the light transmitting substrate 4. The light transmitting conductive layer 7 is constituted of a single-layered graphene. The thickness of the light transmitting conductive layer 7 is approximately 0.3 nm, for example. The light transmitting conductive layer 7 covers the photoelectric conversion region 4*c* in its entirety, is disposed to be laid over the contact portion 6 in the outer edge portion thereof, and is electrically connected to the contact portion 6. More specifically, the light transmitting conductive layer 7 is disposed to be laid over the inner edge portion of the contact portion 6 over the entire circumference of the outer edge portion, and the outer edge portion of the light transmitting conductive layer 7 and the inner edge portion of the contact portion 6 overlap each other over the entire circumference. It is preferable that the light transmitting conductive layer 7 in its entirety be directly covered with the thermal stress alleviation layer 8 described below. Therefore, it is preferable that the light transmitting conductive layer 7 be disposed to be laid over the contact portion 6 as in the present embodiment, without being disposed to be sandwiched between the light transmitting substrate 4 and the contact portion 6. In the present embodiment, the light transmitting conductive layer 7 is disposed to be laid over the contact portion 6 over the entire circumference of the outer edge portion. However, the embodiment is not limited thereto. The photoelectric conversion region 4*c* in its entirety need only be covered with the light transmitting conductive layer 7, and the light transmitting conductive layer 7 and the contact portion 6 need only be electrically connected to each other. For example, the light transmitting conductive layer 7 may be disposed to be laid over the contact portion 6 in a part in the circumferential direction. However, from the viewpoint of improvement in cathode uniformity, when the light transmitting conductive layer 7 is disposed to be laid over the contact portion 6 over the entire circumference of the outer edge portion, this is preferable because a distribution of electrical resistance inside the photoelectric conversion region 4*c* becomes uniform easily.

The thermal stress alleviation layer 8 is provided on the lower surface side of the light transmitting conductive layer 7 such that the light transmitting conductive layer 7 in its entirety is covered. More specifically, the thermal stress alleviation layer 8 covers the lower surface of the light transmitting conductive layer 7 in its entirety in a state where it comes into direct contact with the light transmitting conductive layer 7. In addition, the thermal stress alleviation layer 8 is provided such that the outer edge portion thereof is positioned on a side outward from the outer edge of the light transmitting conductive layer 7 and covers a part of the contact portion 6. In other words, the thermal stress alleviation layer 8 is provided in a range such that also a part of the contact portion 6 is covered beyond a boundary between the light transmitting conductive layer 7 and the contact portion 6. In the present embodiment, the thermal stress alleviation layer 8 comes into contact with the seal member 5 in the outer edge portion. The thermal stress alleviation layer 8 need only cover at least the light transmitting conductive layer 7 in its entirety. However, in order to protect an outer end portion of the light transmitting conductive layer 7, it is preferable that the thermal stress alleviation layer 8 be provided to reach the contact portion 6 beyond the light transmitting conductive layer 7 as in the present embodiment. In addition, when the thermal stress alleviation layer 8 in its entirety is disposed on the light transmitting conductive layer 7 and the contact portion 6, that is, on a conductive layer, electric charge is favorably supplied to the photoelectric conversion layer 9 via the thermal stress alleviation layer 8.

The thermal stress alleviation layer 8 is inferior to the light transmitting conductive layer 7 with regard to light transmissivity and conductivity but is superior to the photoelectric conversion layer 9 with regard to light transmissivity. The thermal stress alleviation layer 8 is composed of aluminum oxide ($Al_2O_3$), hafnium oxide ($HfO_2$), chromium oxide ($CrzO_3$), gallium oxide ($Ga_2O_3$), silicon dioxide ($SiO_2$), or magnesium fluoride ($MgF_2$), for example. The thermal stress alleviation layer 8 has a film thickness of approximately 10 nm, for example, and is formed to be thicker than the light transmitting conductive layer 7 such that supply of electric charge from the light transmitting conductive layer 7 to the photoelectric conversion layer 9 is not hindered while curbing reflection of incident light. The thermal stress alleviation layer 8 is formed by vapor deposition, for example. Since the thermal stress alleviation layer 8 is disposed under a high temperature environment when the photoelectric conversion layer 9 is formed as described below, it is constituted of a thermally stable material. In addition, since the thermal stress alleviation layer 8 is disposed inside the sealed container 13 (inside a vacuum space), it is formed of a material which releases less gas. Moreover, the thermal stress alleviation layer 8 is formed of a material having a refractive index such that reflection of incident light on a boundary surface with respect to the light transmitting conductive layer 7 and a boundary surface with respect to the photoelectric conversion layer 9 can be curbed. However, since a single-layered graphene constituting the light transmitting conductive layer 7 is extremely thin and an influence of the light transmitting conductive layer 7 on reflection is then relatively small, the thermal stress alleviation layer 8 may be formed of a material having a refractive index between those of the light transmitting substrate 4 and the photoelectric conversion layer 9.

The photoelectric conversion layer 9 is provided on the lower surface side of the thermal stress alleviation layer 8 such that the thermal stress alleviation layer 8 is covered. More specifically, the photoelectric conversion layer 9 covers the lower surface of the thermal stress alleviation layer 8 in its entirety in a state where it does not come into direct contact with the light transmitting conductive layer 7. The photoelectric conversion layer 9 is provided such that the photoelectric conversion region 4*c* is covered. In other words, the photoelectric conversion layer 9 is provided in a region including the photoelectric conversion region 4*c* when viewed in the light incident direction (up-down direction in FIG. 4). The photoelectric conversion layer 9 converts light emitted from the inner surface 4*b* of the light transmitting substrate 4 into photoelectrons. The photoelectric conversion layer 9 is a bialkali photoelectric surface or a cesium-tellurium photoelectric surface, for example. A bialkali photoelectric surface is obtained by causing alkali metals of two kinds to react with antimony (Sb) to be activated and is constituted by including antimony and alkali metals of two kinds. Combinations of alkali metals of two kinds which react with antimony include a combination of potassium (K) and cesium (Cs), a combination of rubidium (Rb) and cesium, a combination of sodium (Na) and potassium, and the like. A cesium-tellurium photoelectric surface is constituted by including tellurium (Te) and cesium. Another layer may be additionally provided between the thermal stress alleviation layer 8 and the photoelectric conversion layer 9.

Here, the thermal expansion coefficient of the thermal stress alleviation layer 8 is smaller than the thermal expansion coefficient of the photoelectric conversion layer 9 and is larger than the thermal expansion coefficient of the graphene (light transmitting conductive layer 7). More specifically, it is preferable that the thermal expansion coefficient of the thermal stress alleviation layer 8 be within a range of $0.0\times10^{-6}$/K to $10.0\times10^{-6}$/K. Moreover, it is preferable that the thermal stress alleviation layer 8 be composed of oxide or fluoride. For example, materials constituting the thermal stress alleviation layer 8 include aluminum oxide, hafnium oxide, chromium oxide, gallium oxide, silicon dioxide, and magnesium fluoride. The thermal expansion coefficients for the thermal stress alleviation layer 8 in the cases thereof are set to $7.0\times10^{-6}$/K, $3.8\times10^{-6}$/K, $6.2\times10^{-6}$/K, 8.2 to $8.5\times10^{-6}$/K, $0.5\times10^{-6}$/K, and $8.48\times10^{-6}$/K, respectively. In contrast, for example, in a case of a bialkali photoelectric surface including antimony, the thermal expansion coefficient of the photoelectric conversion layer 9 can be regarded such that it is equivalent to a thermal expansion coefficient of antimony, that is, $12.0\times10^{-6}$/K. In addition, when the photoelectric conversion layer 9 is constituted of a cesium-tellurium photoelectric surface, the thermal expansion coefficient of the photoelectric conversion layer 9 can be regarded such that it is equivalent to a thermal expansion coefficient of tellurium, that is, $16.8\times10^{-6}$/K. Furthermore, the thermal expansion coefficient of the graphene is set to $(-8.0\pm0.7)\times10^{-6}$/K. In addition, when the light transmitting substrate 4 is formed of synthetic quartz, UV ray transmitting glass, and Kovar glass, the thermal expansion coefficients for the light transmitting substrate 4 are set to $0.5\times10^{-6}$/K, $4.1\times10^{-6}$/K, and $3.2\times10^{-6}$/K, respectively, and it is smaller than the thermal expansion coefficient of the photoelectric conversion layer 9 and larger than the thermal expansion coefficient of the graphene (light transmitting conductive layer 7). The thermal expansion coefficient of the graphene is disclosed in the following reference literature, for example.

(Reference literature) Duhee Yoon, Young-Woo Son, and Hyeonsik Cheong, "Negative Thermal Expansion Coefficient of Graphene Measured by Raman Spectroscopy", NANO LETTERS, 2011, 11(8), pp. 3227-3231

Therefore, for example, when the thermal stress alleviation layer 8 is composed of aluminum oxide, hafnium oxide, chromium oxide, gallium oxide, silicon dioxide or magnesium fluoride, and the photoelectric conversion layer 9 is constituted of a bialkali photoelectric surface or a cesium-tellurium photoelectric surface, the thermal expansion coefficient of the thermal stress alleviation layer 8 is smaller than the thermal expansion coefficient of the photoelectric conversion layer 9 and larger than the thermal expansion coefficient of the graphene. In these cases, the thermal expansion coefficient of the thermal stress alleviation layer 8 is within a range of $0.0\times10^{-6}$/K to $10.0\times10^{-6}$/K. In addition, at this time, when the light transmitting substrate 4 is formed of synthetic quartz, an UV ray transmitting material, or Kovar glass, the difference between the thermal expansion coefficient of the thermal stress alleviation layer 8 and the thermal expansion coefficient of the light transmitting substrate 4 is equivalent to or smaller than $8.0\times10^{-6}$/K. When the thermal stress alleviation layer 8 is composed of aluminum oxide, hafnium oxide, chromium oxide, gallium oxide, or magnesium fluoride; the light transmitting substrate 4 is formed of synthetic quartz, an UV ray transmitting material, or Kovar glass; and the photoelectric conversion layer 9 is constituted of a bialkali photoelectric surface or a cesium-tellurium photoelectric surface, the thermal expansion coefficient of the thermal stress alleviation layer 8 is larger than a value obtained by dividing the sum total of the thermal expansion coefficients of the light transmitting substrate 4, the thermal expansion coefficient of the graphene, and the thermal expansion coefficient of the photoelectric conversion layer 9 by six and is equivalent to or smaller than $10.0\times10^{-6}$/K. When the light transmitting substrate 4 is formed of synthetic quartz, and the thermal stress alleviation layer 8 is composed of silicon dioxide, both the light transmitting substrate 4 and the thermal stress alleviation layer 8 are constituted by including silicon dioxide.

Subsequently, an example of a method of manufacturing the transmissive photocathode 2 will be described. First, the contact portion 6 is formed by vapor-depositing chromium in an outer circumferential edge portion on the inner surface 4*b* of the light transmitting substrate 4. Subsequently, the light transmitting conductive layer 7 constituted of a graphene is disposed such that it covers the photoelectric conversion region 4*c* in its entirety on the inner surface 4*b* of the light transmitting substrate 4 and is laid over the inner edge portion of the contact portion 6 over the entire circumference of the outer edge portion. This graphene is disposed, for example, by forming a film-shaped single-layered graphene on a copper foil through CVD and transferring the formed graphene such that the photoelectric conversion region 4*c* in its entirety on the inner surface 4*b* of the light transmitting substrate 4 is covered. Subsequently, the light transmitting substrate 4 and the side tube 3 are air-tightly joined to each other with the seal member 5 interposed therebetween by joining the seal member 5 to the lower surface of the contact portion 6. Subsequently, the thermal stress alleviation layer 8 is formed, for example, by vapor-depositing aluminum oxide such that the lower surface side of the contact portion 6 exposed to the inside of the side tube 3 and the lower surface side of the light transmitting conductive layer 7 in its entirety are covered. Subsequently, for example, antimony is vapor-deposited such that the lower surface side of the thermal stress alleviation layer 8 in its entirety is covered. Furthermore, a bialkali photoelectric surface is formed as the photoelectric conversion layer 9 by causing an alkali metal such as potassium or cesium to react with antimony to be activated using a transfer device. Thereafter, the sealed container 13 is formed by welding the flange portion 12*a* of the ring-shaped side tube 12, to which the stem 10 having the electron multiplier 14 installed therein is air-tightly fixed, to the flange portion 3*a* of the side tube 3. Accordingly, the photomultiplier tube 1 is obtained.

Figure 5:
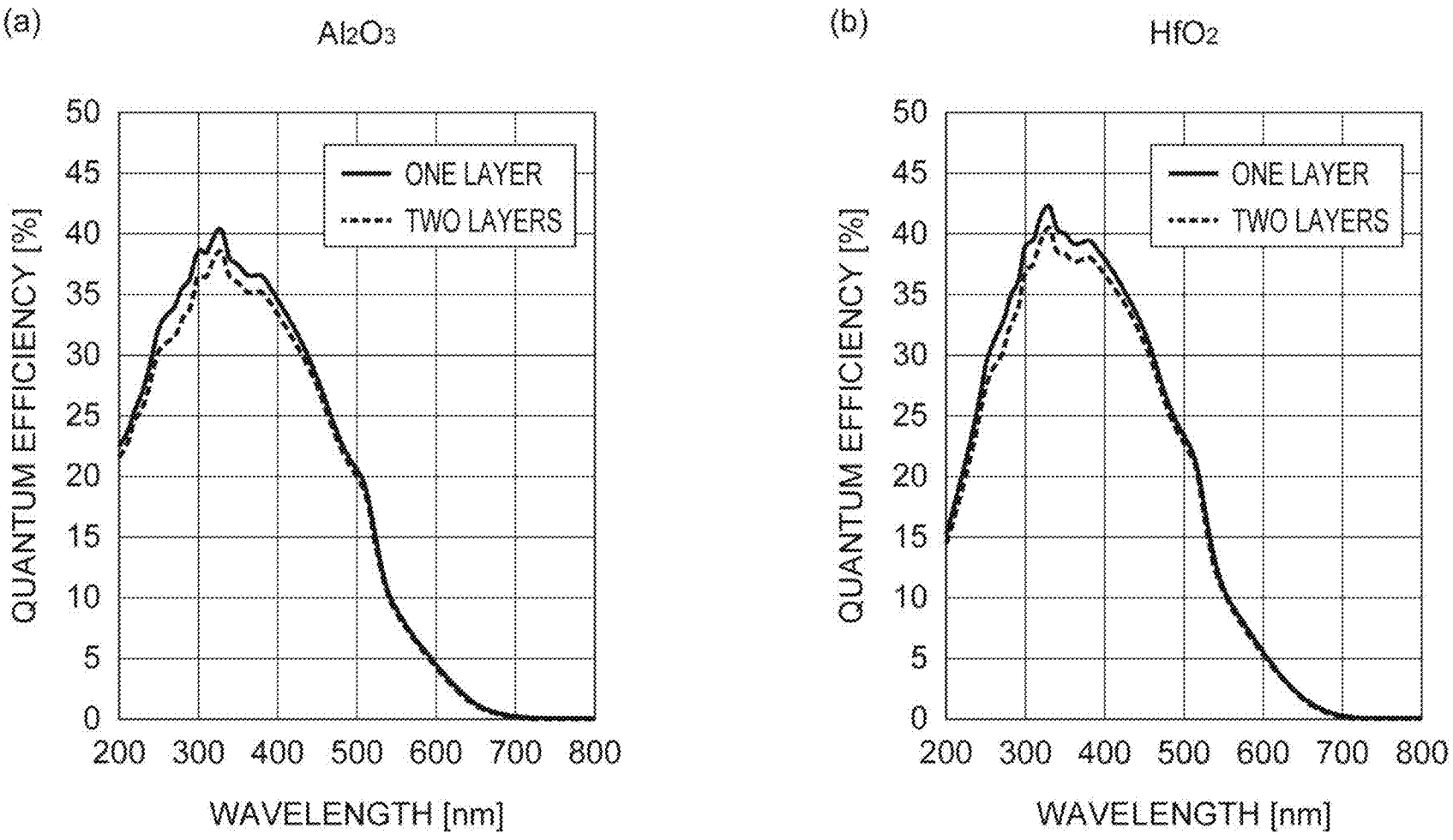
FIGS. 5(*a*) and 5(*b*) are graphs showing measurement results of quantum efficiency when the number of graphene layers for a light transmitting conductive layer is changed in the transmissive photocathode illustrated in FIG. 1.

Subsequently, with reference to FIGS. 5(*a*) and 5(*b*), superiority of the light transmitting conductive layer 7 constituted of a single-layered graphene will be described. FIGS. 5(*a*) and 5(*b*) are graphs showing measurement results of quantum efficiency when the number of graphene layers for the light transmitting conductive layer 7 is changed in the transmissive photocathode 2. In the example of FIG. 5(*a*), the thermal stress alleviation layer 8 is composed of aluminum oxide, and in the example of FIG. 5(*b*), the thermal stress alleviation layer 8 is composed of hafnium oxide.

As illustrated in FIGS. 5(*a*) and 5(*b*), even in the example of both cases where the thermal stress alleviation layer 8 was composed of aluminum oxide and hafnium oxide, sensitivity was higher in the light transmitting conductive layer 7 constituted of a one-layer graphene than that constituted of a two-layer graphene. Particularly, the difference therebetween in sensitivity was relatively small in a visible region but the difference therebetween in sensitivity was significant in a wavelength range of 250 nm to 350 nm. As a reason therefor, it is conceivable that the rate of absorption of π-electrons by a graphene be high in the wavelength range of 250 nm to 350 nm. From these, from the viewpoint of improvement in sensitivity, it can be seen that the light transmitting conductive layer 7 is preferably constituted of a single-layered graphene.

Figure 6:
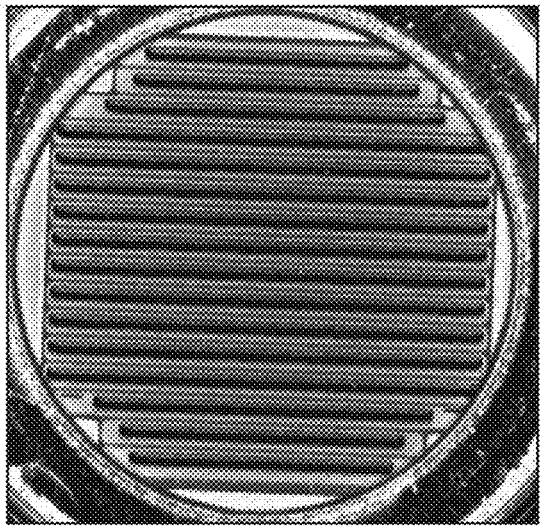
FIG. 6(*a*) is a view illustrating the appearance of a photomultiplier tube using a transmissive photocathode according to Example 1, and FIG. 6(*b*) is a view illustrating the appearance of a photomultiplier tube using a transmissive photocathode according to Comparative Example.
Figure 6:
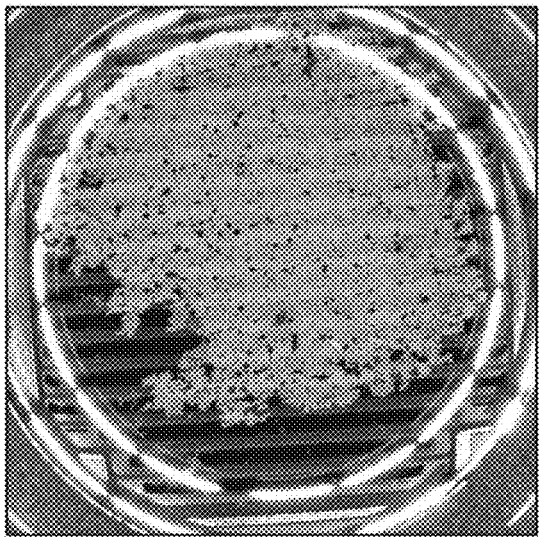
Figure 7:
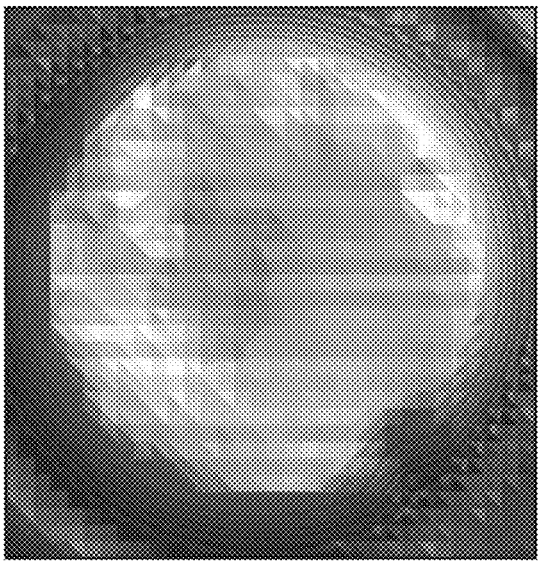
FIG. 7(*a*) is a view illustrating measurement results of cathode uniformity of the photomultiplier tube using the transmissive photocathode according to Example 1, and FIG. 7(*b*) is a view illustrating measurement results of cathode uniformity of the photomultiplier tube using the transmissive photocathode according to Comparative Example.
Figure 7:
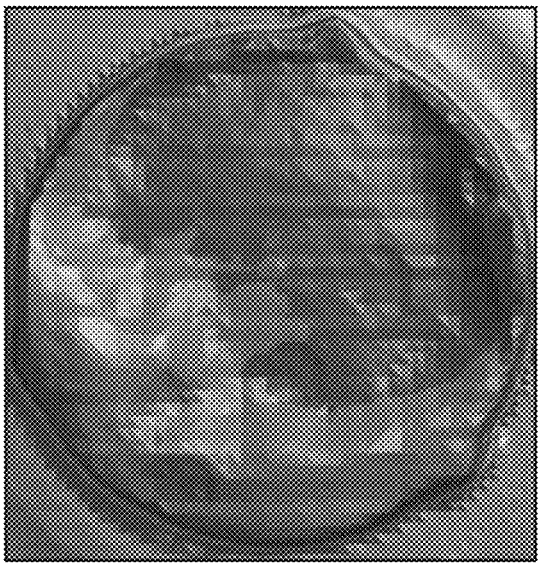
Figure 8:
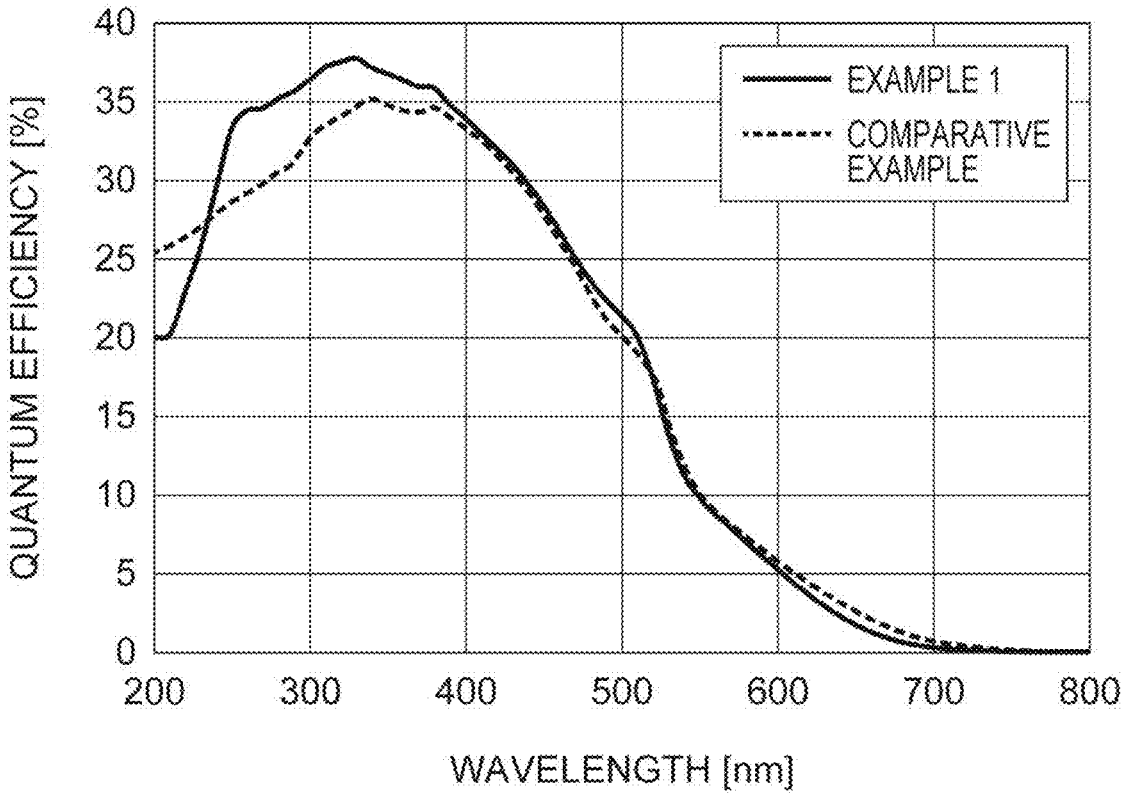
FIG. 8 is a graph showing measurement results of quantum efficiency of the photomultiplier tube using the transmissive photocathode according to Example 1 and the photomultiplier tube using the transmissive photocathode according to Comparative Example.
Figure 9:
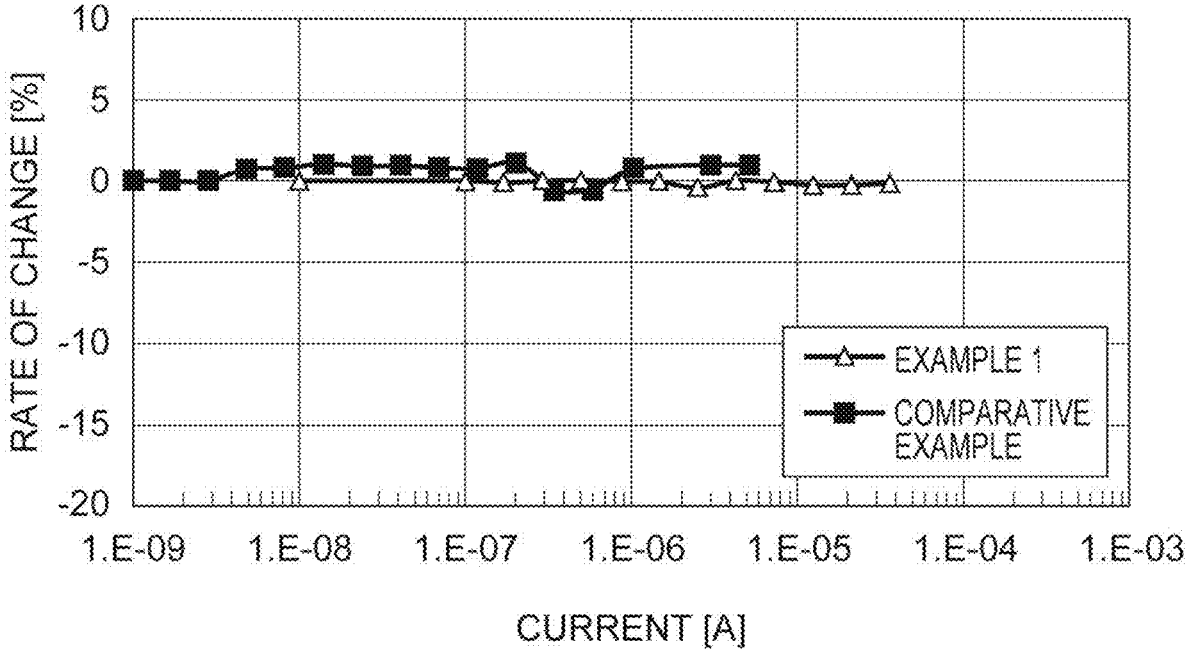
FIG. 9 is a graph showing measurement results of cathode linearity of the photomultiplier tube using the transmissive photocathode according to Example 1 and the photomultiplier tube using the transmissive photocathode according to Comparative Example.

Subsequently, with reference to FIGS. 6(*a*) to 9, superiority in providing the thermal stress alleviation layer 8 between the light transmitting conductive layer 7 and the photoelectric conversion layer 9 will be described. FIGS. 6(*a*) and 6(*b*) are views illustrating the appearance of a photomultiplier tube using a transmissive photocathode according to Example 1 and a photomultiplier tube using a transmissive photocathode according to Comparative Example. FIGS. 7(*a*) and 7(*b*) are views illustrating measurement results of cathode uniformity of the photomultiplier tube using the transmissive photocathode according to Example 1 and the photomultiplier tube using the transmissive photocathode according to Comparative Example. FIGS. 8 and 9 are graphs showing measurement results of quantum efficiency and cathode linearity of the photomultiplier tube using the transmissive photocathode according to Example 1 and the photomultiplier tube using the transmissive photocathode according to Comparative Example.

Here, regarding the foregoing photomultiplier tube 1, Example 1 was a sample equivalent to a case where the light transmitting substrate 4 was formed of an UV ray transmitting material, the thermal stress alleviation layer 8 was composed of aluminum oxide, and the photoelectric conversion layer 9 was constituted of a bialkali photoelectric surface. Comparative Example was a sample equivalent to a case where the thermal stress alleviation layer 8 was not formed in Example 1.

As illustrated in FIGS. 6(*a*) and 6(*b*), the state of the light transmitting conductive layer was favorable in Example 1, but creases (stains) occurred in a wide range including the central portion of the light transmitting conductive layer in Comparative Example. From this, it can be seen that it is more preferable to form the photoelectric conversion layer 9 on the light transmitting conductive layer 7 with the thermal stress alleviation layer 8 interposed therebetween than to directly form the photoelectric conversion layer 9 on the light transmitting conductive layer 7.

As illustrated in FIGS. 7(*a*) and 7(*b*), cathode uniformity (uniformity of output sensitivity) was favorable throughout the photoelectric conversion layer in its entirety in Example 1. However, in Comparative Example, sensitivity was degraded in regions where creases occurred, and therefore cathode uniformity deteriorated. In addition, as illustrated in FIG. 8, high sensitivity was obtained in a wavelength range of 250 nm to 500 nm in Example 1, but sensitivity was also degraded in accordance with deterioration in cathode uniformity in Comparative Example.

In the graph of FIG. 9, the horizontal axis indicates a cathode output current value, and the vertical axis indicates the rate of change expressing the degree of deviation of the cathode output current value with respect to the current value (ideal value) in a case of indicating ideal linearity. That is, the rate of change closer to 0% indicates that linearity is more favorable. As illustrated in FIG. 9, both Example 1 and Comparative Example had favorable cathode linearity. From this, it can be seen that creases occurred in the photoelectric conversion layer in Comparative Example but conduction between the photoelectric conversion layer and the contact portion were maintained.

As described above, in the transmissive photocathode 2 according to the present embodiment, the light transmitting conductive layer 7 is constituted of a single-layered graphene. Accordingly, compared to a case where the light transmitting conductive layer 7 is constituted of a plurality of graphene layers, light transmittance of the light transmitting conductive layer 7 can be enhanced, and sensitivity can be enhanced.

In addition, the inventors have found that defects occurring in the light transmitting conductive layer 7 occur due to a difference between the thermal expansion coefficients of the graphene (light transmitting conductive layer 7) and the photoelectric conversion layer 9 when a metal layer (for example, a layer composed of antimony) is formed on the light transmitting conductive layer 7 and the photoelectric conversion layer 9 is formed by causing an alkali metal (for example, potassium and cesium) to react with the metal layer. That is, when the photoelectric conversion layer 9 is formed, for example, each of the members is cooled after being placed under a high temperature environment heated up to approximately 220° C. through vacuum baking treatment. If the thermal stress alleviation layer 8 is not provided between the light transmitting conductive layer 7 and the photoelectric conversion layer 9, the photoelectric conversion layer 9 and the light transmitting substrate 4 expand and the light transmitting conductive layer 7 meanwhile contracts at the time of heating. Therefore, there is concern that tensile stress acts on the light transmitting conductive layer 7 and breakage such as fracture occurs. In addition, the photoelectric conversion layer 9 and the light transmitting substrate 4 contract and the light transmitting conductive layer 7 meanwhile expands at the time of cooling. Therefore, there is concern that compressive stress acts on the light transmitting conductive layer 7 and the light transmitting conductive layer 7 is flocculated, thereby causing creases.

Based on the knowledge, in the transmissive photocathode 2, the thermal stress alleviation layer 8 having a thermal expansion coefficient smaller than the thermal expansion coefficient of the photoelectric conversion layer 9 and larger than the thermal expansion coefficient of the graphene is provided between the photoelectric conversion layer 9 and the light transmitting conductive layer 7. Accordingly, it is possible to alleviate thermal stress acting on the light transmitting conductive layer 7 when the photoelectric conversion layer 9 is formed. As a result, occurrence of defects in the light transmitting conductive layer 7 can be curbed even when a single-layered graphene is used as the light transmitting conductive layer 7.

In addition, in the transmissive photocathode 2, the thermal expansion coefficient of the thermal stress alleviation layer 8 is within a range of $0.0\times10^{-6}$/K to $10.0\times10^{-6}$/K. In addition, the thermal stress alleviation layer 8 is composed of oxide or fluoride. In addition, the thermal stress alleviation layer 8 is composed of aluminum oxide, hafnium oxide, chromium oxide, gallium oxide, silicon oxide, or magnesium fluoride. Consequently, occurrence of defects in the light transmitting conductive layer 7 can be curbed reliably.

In addition, in the transmissive photocathode 2, the light transmitting substrate 4 is formed of an UV ray transmitting material. In addition, the photoelectric conversion layer 9 is constituted by including antimony or tellurium and an alkali metal. Consequently, in the transmissive photocathode 2 which is highly sensitive in a wavelength range including UV rays, occurrence of defects in the light transmitting conductive layer 7 can be curbed.

Subsequently, with reference to FIGS. 10 to 14, results of an effect confirmation test when the constituent material of the thermal stress alleviation layer 8 is changed will be described. FIG. 10 is a table showing constitutions of transmissive photocathodes according to Examples 1 to 6. Examples 1 to 6 were samples equivalent to a case where the light transmitting substrate 4 was formed of an UV ray transmitting material and the photoelectric conversion layer 9 was constituted of a bialkali photoelectric surface in the transmissive photocathode 2. As illustrated in FIG. 10, in Examples 1 to 6, the thermal stress alleviation layers 8 are composed of aluminum oxide, hafnium oxide, chromium oxide, gallium oxide, magnesium fluoride, and yttrium oxide ($Y_2O_3$), respectively. When the thermal stress alleviation layer 8 is composed of yttrium oxide, the thermal expansion coefficient of the thermal stress alleviation layer 8 is set to $10.1\times10^{-6}$/K.

Figure 11:
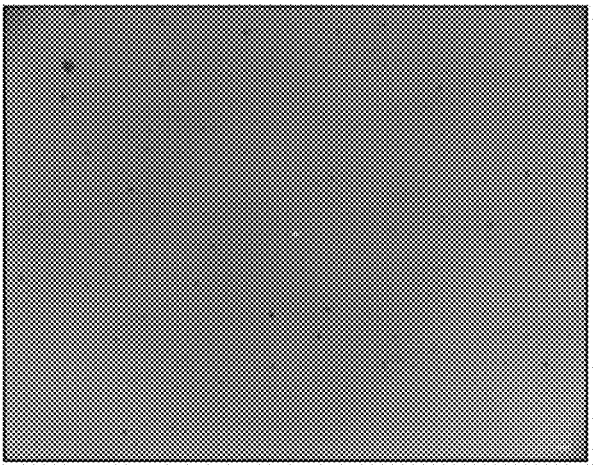
FIGS. 11(*a*) to 11(*c*) are views illustrating microscopic observation results of the light transmitting conductive layers in the transmissive photocathodes according to Examples 1 to 3.
Figure 11:
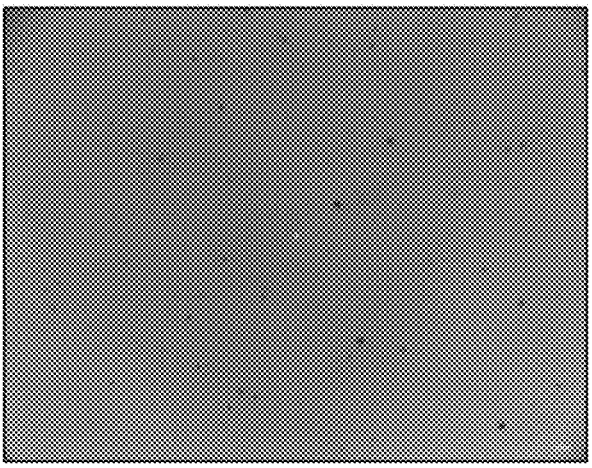
Figure 11:
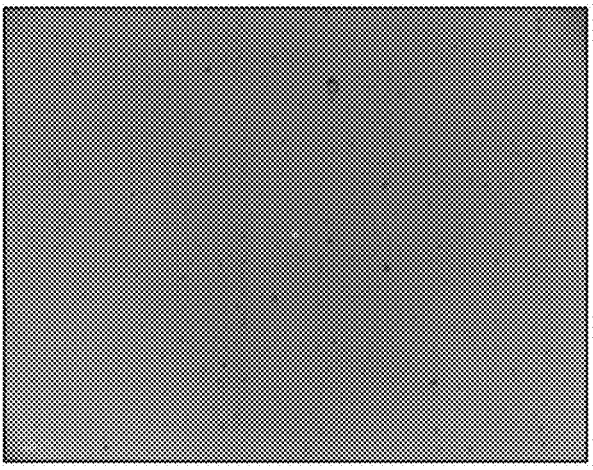
Figure 12:
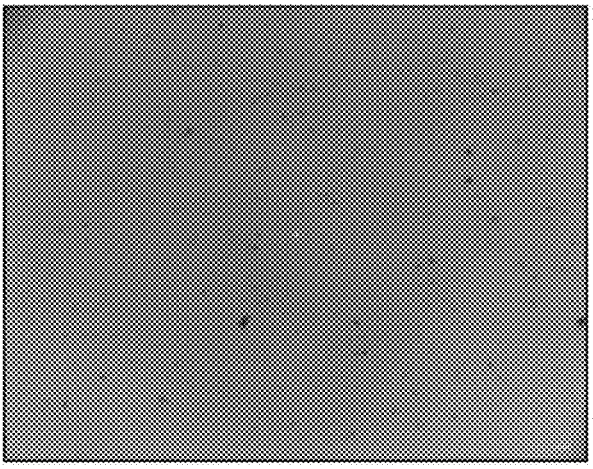
FIGS. 12(*a*) to 12(*c*) are views illustrating microscopic observation results of the light transmitting conductive layers in the transmissive photocathodes according to Examples 4 to 6.
Figure 12:
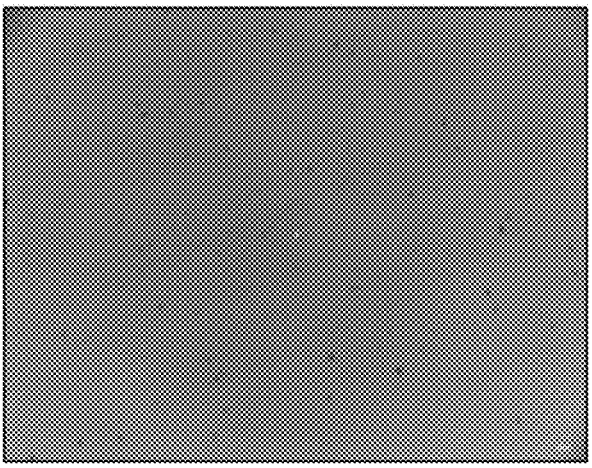
Figure 12:
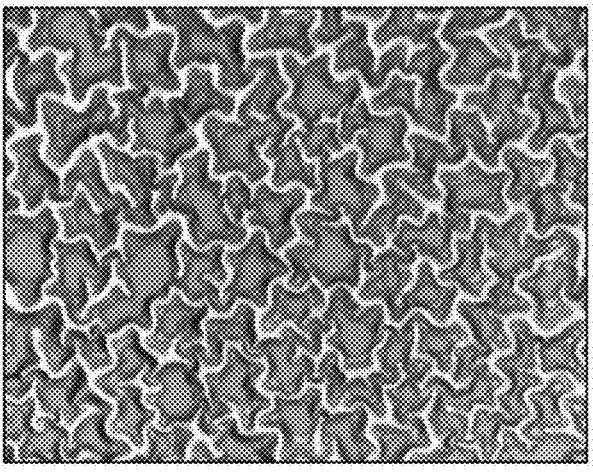

FIGS. 11(*a*) to 12(*c*) are views illustrating microscopic observation results of the light transmitting conductive layers in the transmissive photocathodes according to Examples 1 to 6. As illustrated in FIGS. 11(*a*) to 12(*c*), the state of the light transmitting conductive layer was favorable in Examples 1 to 5, but creases occurred in the light transmitting conductive layer in Example 6 in which the thermal expansion coefficient of the thermal stress alleviation layer was the largest. From this, it can be seen that occurrence of defects in the light transmitting conductive layer can be curbed reliably when the thermal expansion coefficient of the thermal stress alleviation layer is within a range of $0.0\times10^{-6}$/K to $10.0\times10^{-6}$/K. Moreover, it is preferable that an energy gap be greater than 3 eV and the absorption end wavelength be equal to or smaller than 400 nm.

Figure 13:
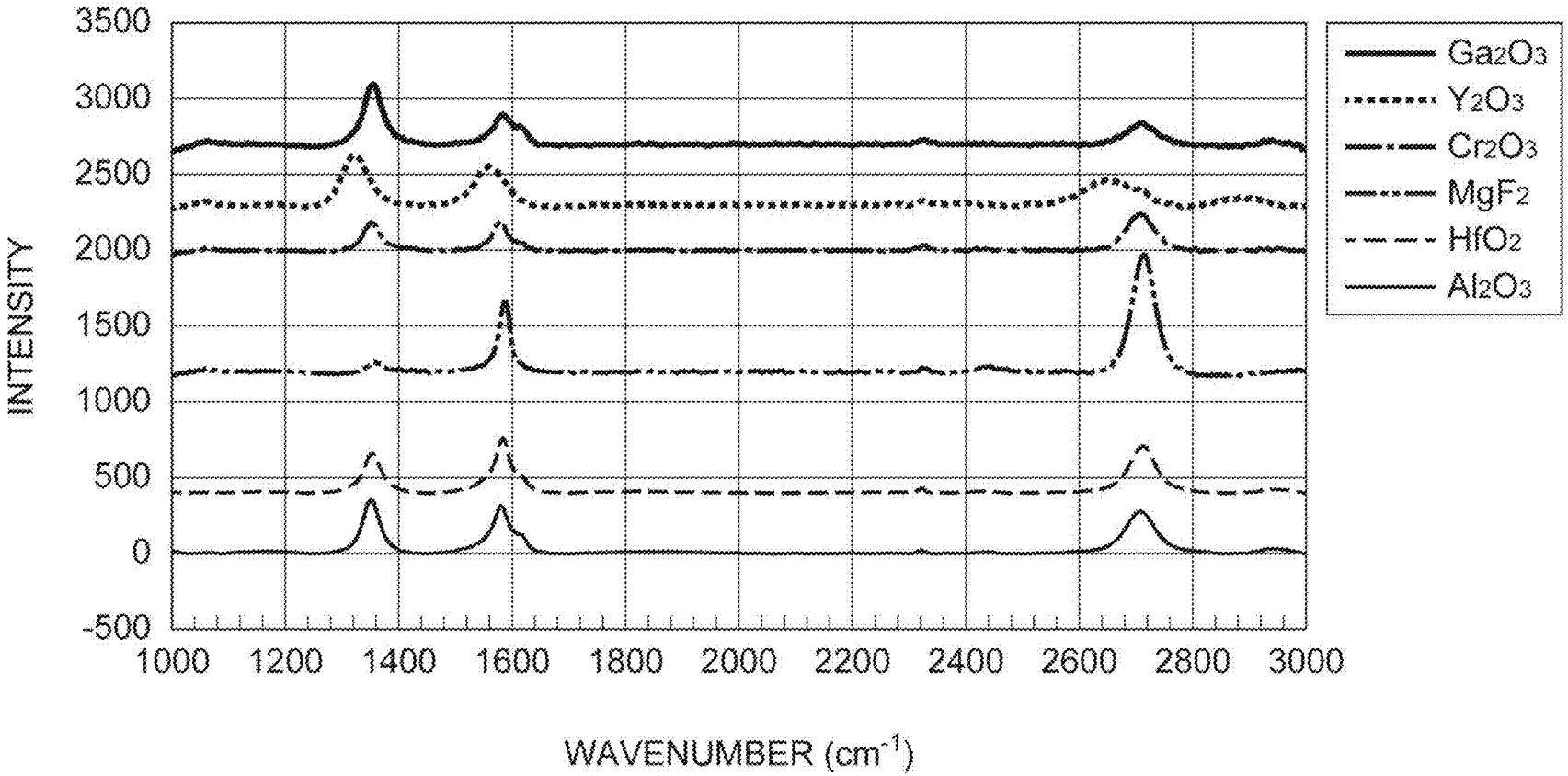
FIG. 13 is a graph showing a Raman spectrum of the light transmitting conductive layers in the transmissive photocathodes according to Examples 1 to 6.
Figure 14:
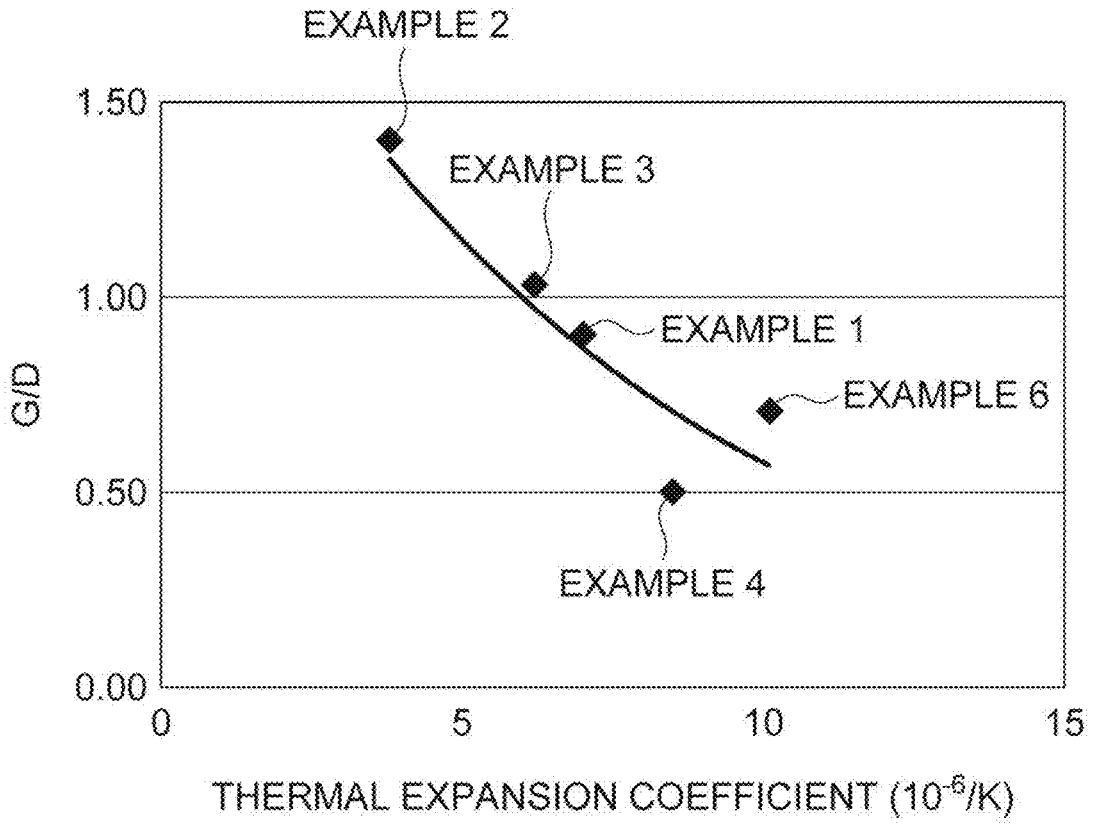
FIG. 14 is a graph showing a relationship between thermal expansion coefficients of the light transmitting conductive layers and a G/D ratio in the transmissive photocathodes according to Examples 1 to 6.

FIG. 13 is a graph showing a Raman spectrum of the light transmitting conductive layers in the transmissive photocathodes according to Examples 1 to 6, and FIG. 14 is a graph showing a relationship between the thermal expansion coefficients of the light transmitting conductive layers and a G/D ratio in the transmissive photocathodes according to Examples 1 to 6. Here, the G/D ratio is a ratio of peak intensities of a G band and a D band. In the G band, a peak is observed in the vicinity of the wavenumber 1590 $cm^{-1}$. This peak reflects the plane structure of carbon in sp2 bonding. In the D band, a peak is observed in the vicinity of the wavenumber 1360 $cm^{1}$. This peak is derived from defects (five-membered ring or the like). The G/D ratio is a ratio of the height of a peak (height from a base portion to an apex portion) in the G band and the height of a peak in the D band. A larger G/D ratio means that the light transmitting conductive layer is less damaged.

As illustrated in FIG. 14, there was a correlationship between the thermal expansion coefficient of the thermal stress alleviation layer and the G/D ratio in Examples 1 to 4 and 6 in which oxide was used as the material of the thermal stress alleviation layer, and the G/D ratio decreased as the thermal expansion coefficient of the thermal stress alleviation layer increased. The curve illustrated in FIG. 14 is a curve expressed by the expression $y=2.22868e^{-0.138x}$ when x is the thermal expansion coefficient of the thermal stress alleviation layer and y is the G/D ratio. In the graph of FIG. 14, points corresponding to Examples 1 to 4 and 6 are distributed along the curve. In Example 5 of Examples, which was the only one using magnesium fluoride that was not oxide, the thermal expansion coefficient of the thermal stress alleviation layer was relatively large. However, the G/D ratio was extremely significant, that is, a value exceeding 1.50, and a distribution along the curve illustrated in FIG. 14 was not achieved. From this, it is conceivable that when the thermal stress alleviation layer is composed of fluoride, occurrence of defects in the light transmitting conductive layer be curbed due to characteristics different from those of oxide.

Figure 15:
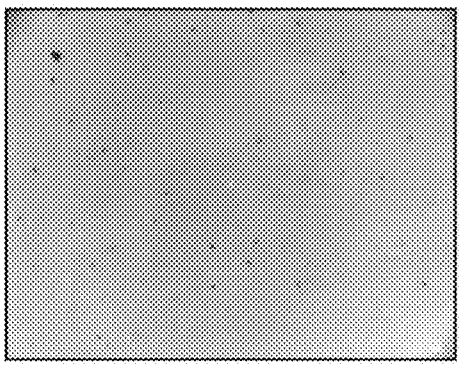
FIGS. 15(*a*) to 15(*d*) are views illustrating microscopic observation results when the number of graphene layers for the light transmitting conductive layer in the transmissive photocathode according to Example 1 is changed.
Figure 15:
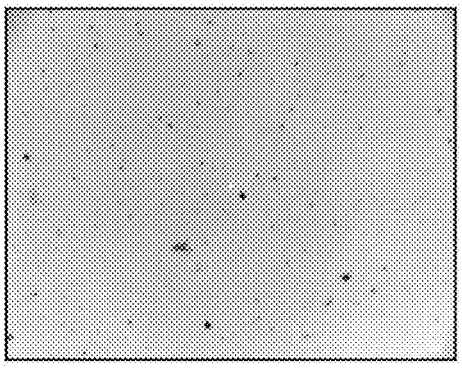
Figure 15:
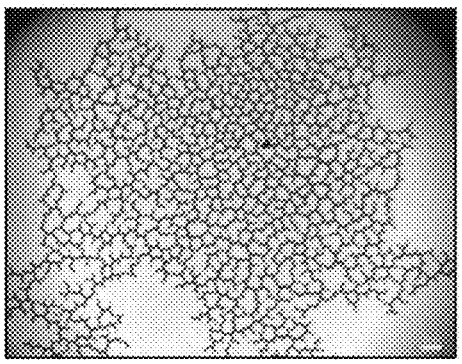
Figure 15:
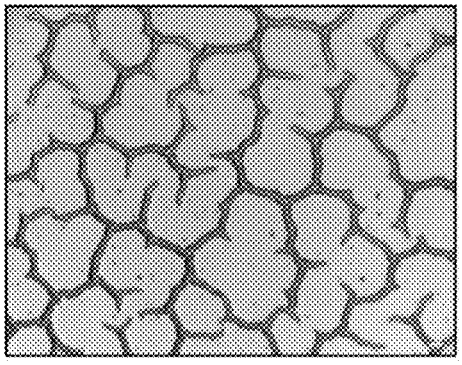

FIGS. 15(*a*) to 15(*d*) are views illustrating microscopic observation results when the number of graphene layers for the light transmitting conductive layer in the transmissive photocathode according to Example 1 is changed. As illustrated in FIGS. 15(*a*) to 15(*d*), when the graphene layer of the light transmitting conductive layer was one layer or two layers, the state of the light transmitting conductive layer was favorable, but creases occurred in the light transmitting conductive layer when the graphene layer of the light transmitting conductive layer was three layers. As a reason therefor, it is conceivable that compressive stress increase as the number of layers of the graphene layer increases and the effect of the thermal stress alleviation layer be no longer sufficient.

The present disclosure is not limited to the foregoing embodiment. For example, the material and the shape of each constitution is not limited to the materials and the shapes described above, and various materials and shapes can be employed. In addition, for example, the transmissive photocathode according to the present disclosure can be used as a transmissive photocathode in an electron tube such as a photoelectric tube, an image intensifier, a streak tube, and an X-ray image intensifier, in addition to a photomultiplier tube.

REFERENCE SIGNS LIST

2 Transmissive photocathode
4 Light-transmitting substrate
4*a* Outer surface (first surface)
4*b* Inner surface (second surface)
7 Light-transmitting conductive layer
8 Thermal stress alleviation layer
9 Photoelectric conversion layer

The invention claimed is:

1. A transmissive photocathode comprising:

a light transmitting substrate that has a first surface on which light is incident and a second surface which emits the light incident from a side of the first surface;

a photoelectric conversion layer that is provided on a light emission side of the light transmitting substrate and converts the light emitted from the second surface into photoelectrons;

a light transmitting conductive layer that is provided between the light transmitting substrate and the photoelectric conversion layer and is composed of a single-layered graphene; and a thermal stress alleviation layer that is provided between the photoelectric conversion layer and the light transmitting conductive layer and has light transmissivity, wherein a thermal expansion coefficient of the thermal stress alleviation layer is smaller than a thermal expansion coefficient of the photoelectric conversion layer and larger than a thermal expansion coefficient of the graphene.

2. The transmissive photocathode according to claim 1, wherein the thermal expansion coefficient of the thermal stress alleviation layer is within a range of $0.0\times10^{-6}$/K to $10.0\times10^{-6}$/K.

3. The transmissive photocathode according to claim 1, wherein the thermal stress alleviation layer is composed of oxide or fluoride.

4. The transmissive photocathode according to claim 1, wherein the thermal stress alleviation layer is composed of aluminum oxide, hafnium oxide, chromium oxide, gallium oxide, silicon oxide, or magnesium fluoride.

5. The transmissive photocathode according to claim 1, wherein the light transmitting substrate is formed of an UV ray transmitting material.

6. The transmissive photocathode according to claim 1, wherein the photoelectric conversion layer is constituted by including antimony or tellurium and an alkali metal.

7. An electron tube comprising:

the transmissive photocathode according to claim 1.

* * * * *